United States Patent [19]

Arai et al.

[11] Patent Number: 4,801,980

[45] Date of Patent: Jan. 31, 1989

[54] TONER DENSITY CONTROL APPARATUS

[75] Inventors: Tomio Arai; Hiroshi Kuru, both of Hachioji, Japan

[73] Assignee: Konica Corporation, Tokyo, Japan

[21] Appl. No.: 114,106

[22] Filed: Oct. 28, 1987

[30] Foreign Application Priority Data

| | | | |
|---|---|---|---|
| Oct. 29, 1986 | [JP] | Japan | 61-2550862 |
| Oct. 29, 1986 | [JP] | Japan | 61-2550863 |
| Oct. 29, 1986 | [JP] | Japan | 61-165085[U] |
| Oct. 29, 1986 | [JP] | Japan | 61-165086[U] |
| Nov. 5, 1986 | [JP] | Japan | 61-169067[U] |
| Nov. 5, 1986 | [JP] | Japan | 61-169068 [U] |

[51] Int. Cl.[4] ..... G03G 15/08

[52] U.S. Cl. ..... 355/14 D; 355/3 DD; 355/14 R; 118/689; 430/30

[58] Field of Search ..... 355/14 D, 300, 14 R; 118/668, 7, 670, 679, 691; 430/30, 31

[56] References Cited

U.S. PATENT DOCUMENTS

| | | | |
|---|---|---|---|
| 4,239,372 | 12/1980 | Iwai | 355/14 R |
| 4,273,843 | 6/1981 | Fujita et al. | 430/30 |
| 4,451,135 | 5/1984 | Okumura | 355/3 DD |
| 4,466,731 | 8/1984 | Champion et al. | 355/14 D |
| 4,468,112 | 8/1984 | Suzuki et al. | 355/14 D |
| 4,533,234 | 8/1985 | Watai et al. | 355/14 D |

*Primary Examiner*—A. C. Prescott

*Attorney, Agent, or Firm*—Jordan B. Bierman

[57] ABSTRACT

A toner density control apparatus wherein an image density of a reference image on a photosensitive member is compared with a predetermined level to control a toner density, a voltage to be applied on a light-emitting element is controlled according to a difference between an output of a light-receiving element when it receives a light reflected from a non-image surface region on the photosensitive member and correction reference data, and a signal is supplied to the outside when the voltage is increased more than a predetermined value.

10 Claims, 4 Drawing Sheets

TONER DENSITY CONTROL APPARATUS

BACKGROUND OF THE INVENTION

1. Field of the Invention

This invention relates to a toner density control apparatus for a reproducing apparatus.

2. Description of the Prior Art

An electrophotographic reproducing apparatus is operated as shown in FIG. 3. Namely, an original (not shown) placed on a platen glass 1 is scanned by a light source 2 in the direction of an arrow a, and the light reflected on the original is guided to a photosensitive drum 9, which is charged with a high voltage in advance by a charging electrode 8 and rotated in the direction of an arrow b synchronously with the scanning of the original, by an optical system consisting of mirrors 3–6 and a lens 7, to form a latent image on the drum 9. This latent image is developed with a toner by a developing unit 10 in a subsequent process, and the resultant toner image is transferred by a transfer electrode 11 to transfer paper fed in the direction of an arrow c. The resultant transfer paper is separated from the photosensitive drum 9 by a separating electrode 12 and carried to a thermal fixing unit 14 by a transfer belt 13. The image on the transfer paper is fixed in the thermal fixing unit 14, and the resultant transfer paper is discharged therefrom. Reference numeral 15 denotes a cleaning unit for removing the residual toner from the photosensitive drum 9, 16 a lamp for eliminating the unnecessary charge from the surface of the photosensitive drum 9 electrically charged by the charging electrode 8, so as to prevent the wasteful consumption of the toner, and 17 a toner density detecting sensor.

As the toner in the developing unit 10 is fed to the photosensitive drum 9, the amount of toner in the unit 10 decreases, and, when the decrease in amount of the toner has continued, the image becomes thin. To prevent this inconvenience, the toner density is detected by the sensor 17 to control the quantity of the toner in the developing unit 10.

This toner density control operation is carried out by scanning an image (in reference black color) on a reference density plate 18, which is provided in advance on the side of the starting end of the platen glass 1, prior to the scanning of the original, forming a latent image and developing the same, detecting the density of the developed image by the sensor 17, and opening a valve **10*b* in a toner hopper 10*a* in the developing unit 10 predetermined times or for a predetermined period of time when the density of the image is not higher than a reference level, to supply the toner to a sleeve 10*c***.

FIG. 4 shows a toner density control circuit. The sensor 17 consists of a reflecting photocoupler composed of an LED **17*a* as a light-emitting element, and a phototransistor 17*b* as a light-receiving element. Reference letters VR1, VR2 denote variable resistors for regulating the electric current flowing through the LED 17*a*, Q1, Q2 transistors for regulating the voltages at both ends of one variable resistor VR2, Q3 a transistor for amplifying an output from the phototransistor 17*b***, R1 a bias resistor for the base of the transistor Q2, R2, R3 resistors for converting an output current from the transistor Q3 into a voltage, and TH a temperature compensating element.

If the electric current flowing through the LED **17*a* in this circuit is constant (the light-emitting rate is constant), the rate of reflection of the light on the toner is low when the toner density to be detected is high. Accordingly, an output current from the phototransistor 17*b* becomes low, so that the voltage at an output terminal 21** also becomes low. When the toner density is low, the voltage at the output terminal becomes high in contrast to the above-mentioned case.

A comparator (not shown), to which a voltage corresponding to a reference level of the toner density is applied as a comparative reference level, is connected to this output terminal 21. Owing to this arrangement, when a voltage higher than this comparative reference level is outputted, a signal is outputted from the comparator to cause the valve **10*b* in the toner hopper 10*a* to be driven, so that the toner is supplied to the sleeve 10*c***. This control operation is carried out for each sheet-copying action so as to constantly maintain the toner density in a proper level.

In a conventional device, the toner density is controlled to only one certain level. However, different users prefer different image densities. In order to meet these requirements, image density selecting buttons are provided. However, these selector buttons are adapted to be pressed selectively with respect to the density of the original.

The sensor 17 referred to above is set on the upstream side of the cleaner unit 15, and it is therefore contaminated considerably with the toner. This would cause the effective rate of emission of the light from the LED **17*a* to decrease, or prevent a part of the light reflected on the patch image from reaching the phototransistor 17*b***.

If such troubles occur, it is already impossible that an accurate density of the patch image be detected. In such a case, a high toner density is detected, so that the toner is not supplementarily supplied. This causes the image density to lower.

In order to prevent such inconveniences in a conventional device, a serviceman manually washes the toner density sensor while the rate of emission of the light from the light-emitting element is regulated manually by the variable resistor VR1 during the replacement of the photosensitive drum so as to eliminate the scatter, which occurs due to the changed reflectance of the photosensitive drum, of the rate of reflection of the light thereon. Accordingly, the controlling of the toner density is not sufficiently done until the completion of the replacement of the photosensitive drum.

SUMMARY OF THE INVENTION

An object of the present invention is to prevent a decrease in the image density even when the toner density sensor is contaminated with the toner.

To achieve this object, the present invention provides a toner density control apparatus constructed so that the toner density is controlled on the basis of the density, which is detected by a sensor, of a patch image obtained by developing an image on a reference density plate on the surface of a photosensitive drum, characterized in that the apparatus includes means for controlling the rate of emission of a light from a light-emitting element in the sensor so that an output from a light-receiving element, which is adapted to receive a light reflected on the surface of a non-image forming region of the photosensitive drum, in the sensor is in a predetermined level.

Another embodiment of the present invention is directed to a toner density control apparatus constructed so that the toner density is controlled on the basis of the density, which is detected by a sensor, of a patch image obtained by developing an image on a reference density plate on the surface of a photosensitive drum, characterized in that the apparatus includes means for controlling the rate of emission of a light from a light-emitting element in the sensor in accordance with the degree of contamination of the sensor immediately after an original-copying operation has been started and before an image has been formed.

Another object of the present invention is to correct the toner density without causing a decrease in the image density, even when the sensor is contaminated with the toner, and prevent the toner density from being excessively corrected.

To achieve this object, the present invention provides a toner density control apparatus constructed so that the toner density is controlled on the basis of the density, which is detected by a sensor, of a patch image obtained by developing an image on a reference density plate on the surface of a photosensitive drum, characterized in that the apparatus includes means for controlling the power source voltage for a light-emitting element in the sensor in accordance with the degree of contamination of the sensor, and means for controlling said voltage so that the voltage does not exceed a limit level.

Still another object of the present invention is to enable a user to set a toner density freely.

To achieve this object, the present invention provides a toner density control apparatus constructed so that the supplementary supplying of the toner is controlled on the basis of the density, which is detected by a sensor, of a patch image obtained by developing the image on a reference density plate on the surface of a photosensitive drum, characterized in that the apparatus includes means for setting a plurality of judgement levels for making a decision to carry out or not to carry out the supplementary supplying of the toner to a developing unit.

A further object of the present invention is to enable the toner density to be corrected properly even when the sensor is contaminated with the toner, and a user to set the toner density freely.

To achieve this object, the present invention provides a toner density control apparatus constructed so that the toner density is controlled on the basis of the density, which is detected by a sensor, of a patch image obtained by developing the image on a reference density plate on the surface of a photosensitive drum, characterized in that the apparatus includes a device for compensating a decrease in the toner density occurring due to the contamination of the sensor, which device is constructed so that the rate of emission of a light from a light-emitting element in the sensor is controlled in such a manner that an output from a light-receiving element, which is adapted to receive a light reflected on the surface of a non-image forming region of the photosensitive drum, in the sensor is in a reference level, and means for varying said reference level.

The above and other objects and advantageous features of the invention will become clear from the following description of the preferred embodiments taken in conjunction with the accompanying drawings.

DESCRIPTION OF THE PREFERRED EMBODIMENTS

Figure 1:
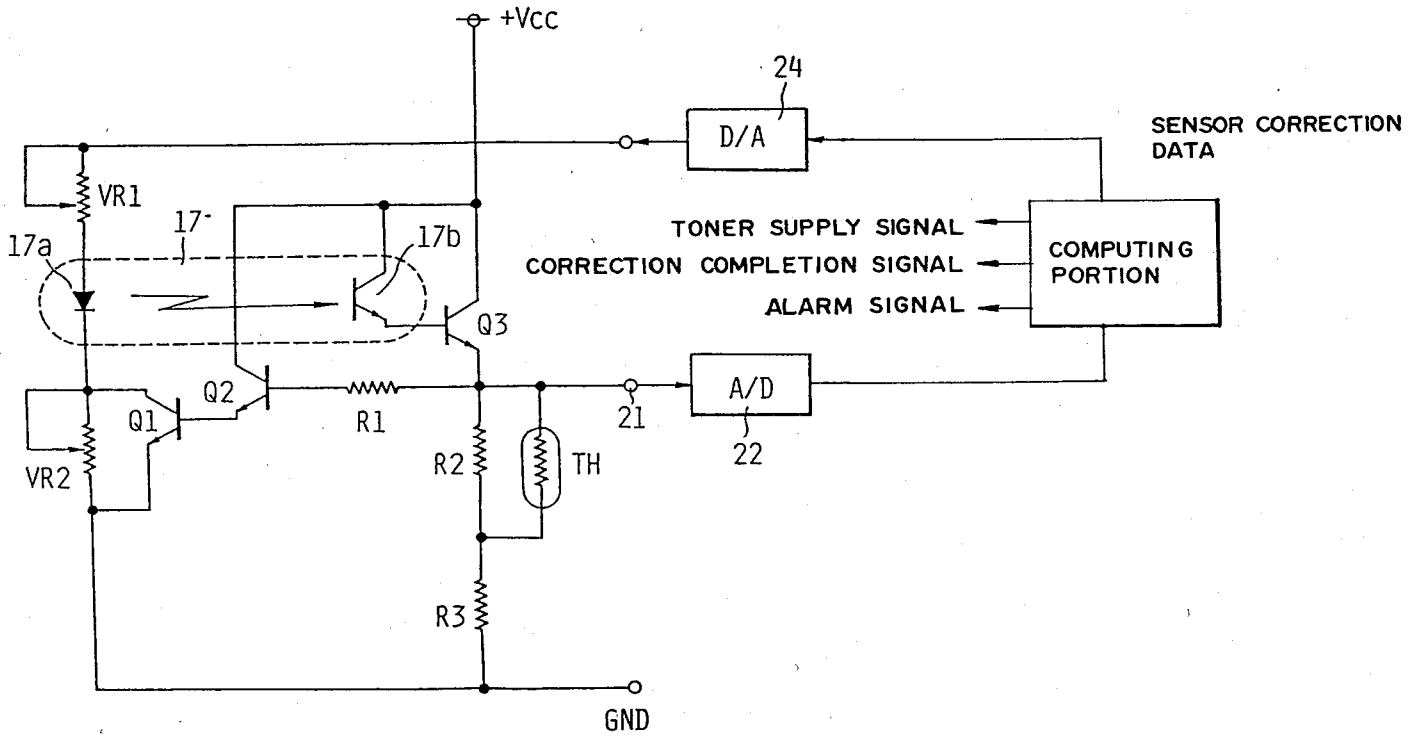
FIG. 1 is a diagram of a circuit for compensating a decrease in the image density, which occurs due to the contamination of a toner density sensor, in an embodiment of the present invention.

The embodiments of the present invention will now be described. FIG. 1 shows a toner density control circuit in an embodiment of the present invention. An output voltage from an output terminal 21 is converted into a digital value of a predetermined bit number by an A/D converter 22, and this digital value is inputted into a computing portion 23. Various results of computations made in this computing portion 23 are outputted as senor correcting data to a D/A converter 24, and also as a toner supply signal, a correction completion signal and an alarm signal therefrom.

Figure 2:
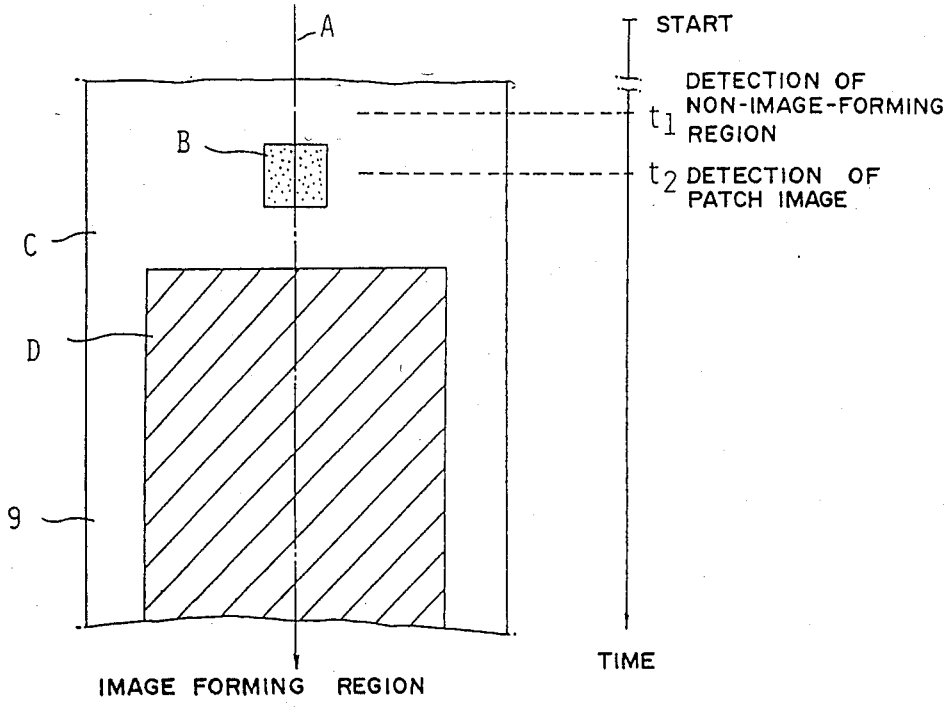
FIG. 2 is a diagram showing the time at which the data on the compensation for a decrease in the image density which occurs due to the contamination of a toner density sensor are taken into the circuit, and the time at which the data on the actual toner density are taken thereinto.
Figure 4:
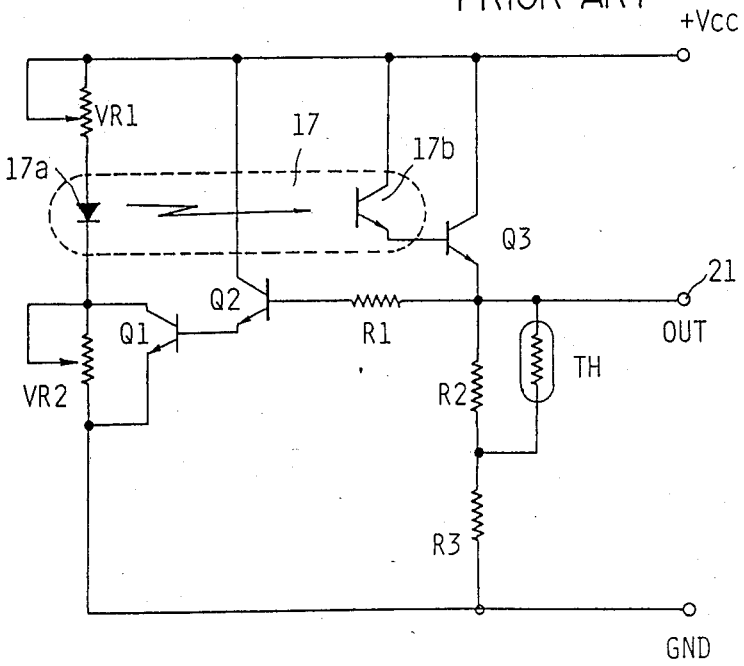
FIG. 4 PRIOR ART
FIG. 4 shows a conventional toner density control circuit.
Figure 3:
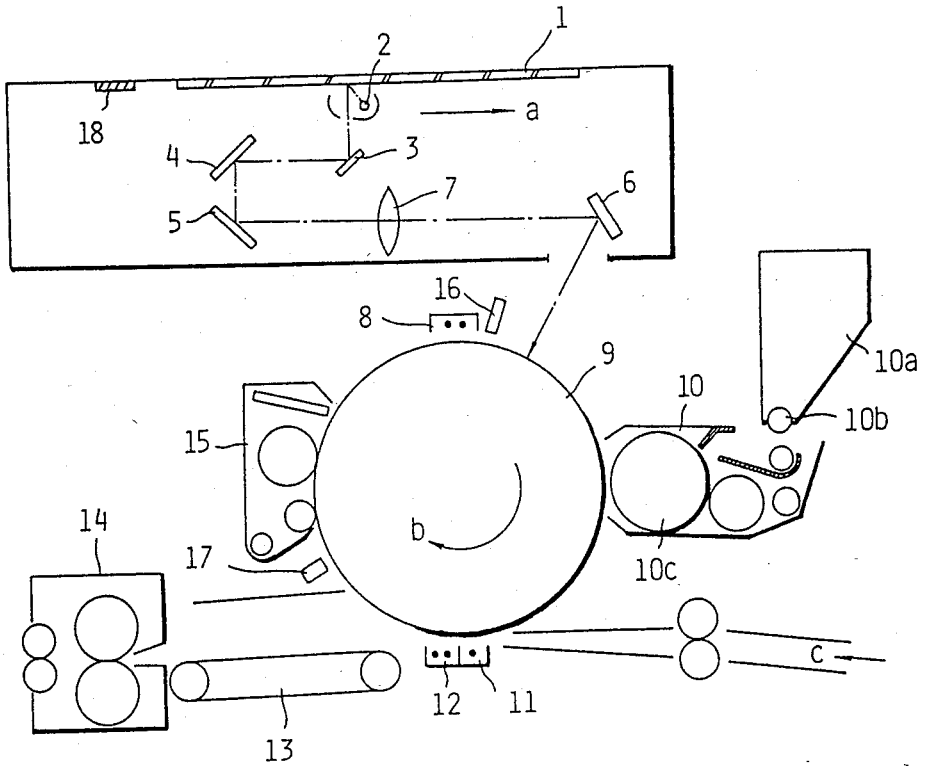
F I G. 3 PRIOR ART
FIG. 3 illustrates the principles of a conventional electrophotographic reproducing apparatus.

As shown by a locus A of a sensor 17 in FIG. 2, the sensor 17 moves over a patch image B, a non-image forming region C and an image forming region D with respect to a photosensitive drum 9. The taking of the toner density information is done at the time $t_2$ at which the patch image B is detected. In this embodiment, reflectance data (density data) on the non-image forming region C of the photosensitive drum 9 are also taken at the time $t_1$ which is immediately after the starting of a copying operation and before the arrival of the sensor 17 at the patch image B and image forming region D.

The reference image can be formed by charging the photosensitive member by the charging electrode 8, making a latent image of a predetermined size by the charge eliminating lamp 16 and developing the latent image without using the reference density plate.

(1) Regarding the controlling of the toner density:

The data taken in at the time $t_2$ are toner density data, which are compared in the computing element 23 with one reference level (judgement level data for making a decision of carrying out or not carrying out the supplementary supplying of the toner) selected from a plurality of reference density levels set in advance in the apparatus. When the input density is lower than the reference level, a signal for supplementarily supplying the toner is outputted from the computing element 23 to drive a valve **10*b* in a toner hopper 10*a***, and supply the toner supplementarily.

Figure 5:
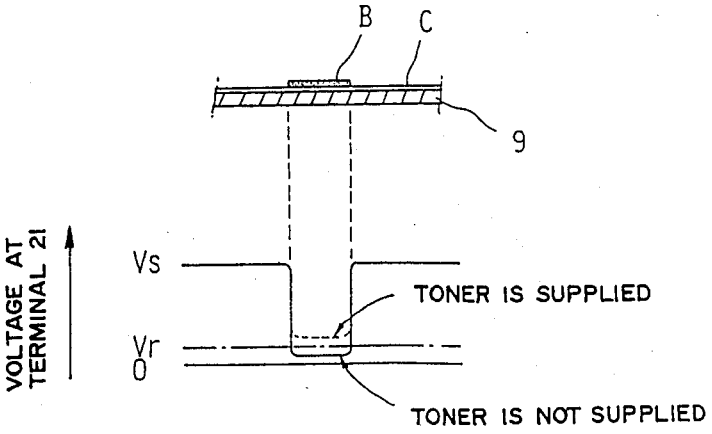
FIG. 5 illustrates the controlling of a toner density.

FIG. 5 shows the characteristics of an output voltage from a terminal 21. Reference letter Vs denotes a voltage representative of a detected reflectance of the non-image forming region C, and Vr a reference voltage representative of the reference density level. When a detected voltage representative of the reflectance of the patch image B is lower than this reference voltage Vr, it is ascertained that the actual toner density is higher than the reference level, so that the toner is not supplementarily supplied. However, when this voltage is higher than the reference voltage Vr, it is ascertained that the actual toner density is lower than the reference level, so that the toner is supplementarily supplied.

(2) Regarding the compensation for a decrease in the toner density which occurs due to the contamination of the sensor:

The sensor 17 is readily contaminated with the flying particles of toner, and, when it is once contaminated with the toner, it becomes impossible to detect the toner density correctly. When the sensor 17 in this embodiment is contaminated with the toner, the degree of the contamination is detected, and the rate of emission of the light from a LED 17*a* is controlled accordingly.

In this embodiment, the voltage at the output terminal 21 in the non-image forming region of the photosensitive drum 9 is regulated manually to a predetermined level by a variable resistor VR1 at the time of shipping of the apparatus or at the time of replacement of the drum. The correction data are stored as the first sensor-correcting reference data in a ROM (not shown). In this ROM, n-pieces of second to n-th sensor-correcting reference data are stored in addition to the first reference data.

While the apparatus is regularly used, the actual reflectance data on the non-image forming region C are taken at the time $t_1$, and the first sensor-correcting reference data and inputted reflectance data are compared, sensor-correcting data corresponding to a difference between these data being sent from a ROM (not shown) containing sensor-correcting data to the D/A converter 24, in which the sensor-correcting data are converted into an analog voltage. This voltage is used as a power source voltage for the LED 17*a*. When the correction has been completed, a signal representative of the completion of the correction is outputted.

Further, it is preferable that the reflectance data on the non-image forming region are taken when the surface of the photosensitive member which has passed through the cleaning unit 15 and cleaned reaches on the sensor portion, so that the sensor correction an be carried out in the non-image forming region positively cleaned.

If the sensor is contaminated in this control operation, reflectance data on the non-image forming region C, which show a low reflectance, are generated, so that the data become different from the first correction reference data. Therefore, if the power source voltage for LED 17*a* is increased to such an extent that corresponds to this difference, the decrease in the reflectance corresponding to the degree of contamination of the sensor is compensated. Accordingly, at the later time $t_2$, the toner density control operation is also carried out at the corrected power source voltage corresponding to the first correction reference data. This enables the toner density control operation to be carried out correctly.

It is not necessary that a decrease in the toner density due to the contamination of the sensor be compensated before each copying operation. In the above embodiment, the data are taken in and processed at the time $t_1$ which is immediately before the time at which the started copying operation advances to the image forming region C. Namely, such a compensation operation is carried out each time the copying start button is pushed.

(3) Regarding the free selection of the toner density:

As previously mentioned, the users do not prefer the same toner density. Some prefer a high toner density, and some a lower toner density. Especially, in order to reduce the consumption of the toner and obtain a good economical effect, it is recommendable to employ a lower toner density In order to meet these requirements, n number of reference level data for correcting the sensor are prepared as mentioned above in the present invention. Therefore, when a high density is desired as a reference density level in the toner density control, reference data for increasing the power source voltage for the LED 17*a* may be selected as reference level data for correcting the sensor. Specifically, when the power source voltage becomes high the light quantity of the LED 17*a* increases and the detected value of the density becomes low, so that it is controlled such that the density becomes higher. Conversely, when a low density is desired, reference level data for correcting the sensor for decreasing the power source voltage may be selected.

These sensor correction reference data should not be limitlessly set; they must be within a permissible range with respect to the deposition of a carrier and the flying of the toner.

The selection of an image density is usually done by pressing a density selecting button to carry out the regulation of the developing bias. On the other hand, in the above-described embodiment, the source voltage of the LED is varied, and this image density selecting method is different from a conventional method of this kind.

Further, in the present invention, a plurality of toner density-controlling reference density levels (i.e. reference level data corresponding to the reference voltage Vr shown in FIG. 5) are prepared in the above embodiment. Therefore, when a high density is desired in a toner density control operation, a higher density reference level (reference level data corresponding to a low reference voltage) may be selected. Conversely, when a low density is desired, a lower density reference level (reference level data corresponding to a high reference voltage) may be selected. In the former case, the supplementary supplying of the toner is done frequently, and, in the latter case, a small number of times. These reference levels should not be limitlessly set; they must be within a permissible range with respect to the deposition of a carrier and the flying of the toner.

The selection of an image density is usually done by pressing a density selecting button to carry out the regulation of the developing bias. On the other hand, in the above-described embodiment, the reference level of the toner density is selected, and this image density selecting method is different from a conventional method of this kind. (4) Regarding the limit of correction:

In the system for compensating a decrease in the toner desnity occurring due to the contamination of the sensor 17, correction can be made in accordance with the degree of the contamination to any extent in theory. This correction method is carried out by increasing the power source voltage for the LED 17*a*. Therefore, if the voltage is increased to not less than a certain limit level, there is the possibility that the LED is broken, and a signal representative of the completion of the correction is not outputted in some cases.

In order to prevent such inconveniences, the sensor-correcting data (data for the power source voltage) are limited, and the limit data (final data) for rendering the voltage maximal are stored in ROM in advance in this embodiment. When a level not less than a level included in the limit data is selected on the basis of a difference between the sensor-correcting reference data and the inputted reflectance data, the limit data are outputted as the sensor-correcting data. The sensor-correcting operation is completed by the output of these limit data. A signal representative of the completion of the correction is then outputted, and an alarm is given at the same time.

Accordingly, if these limit data are set as the data corresponding to a power source voltage for generating an electric current allowed by the LED 17*a*, the breakage of the LED 17*a* can be prevented, and a signal representative of the completion of the correction can be outputted reliably at the same time. The advancement of the contamination of the sensor to not lower than a tolerable level is also made known by the alarm data.

At this time, the apparatus can be suspended.

Figure 6:
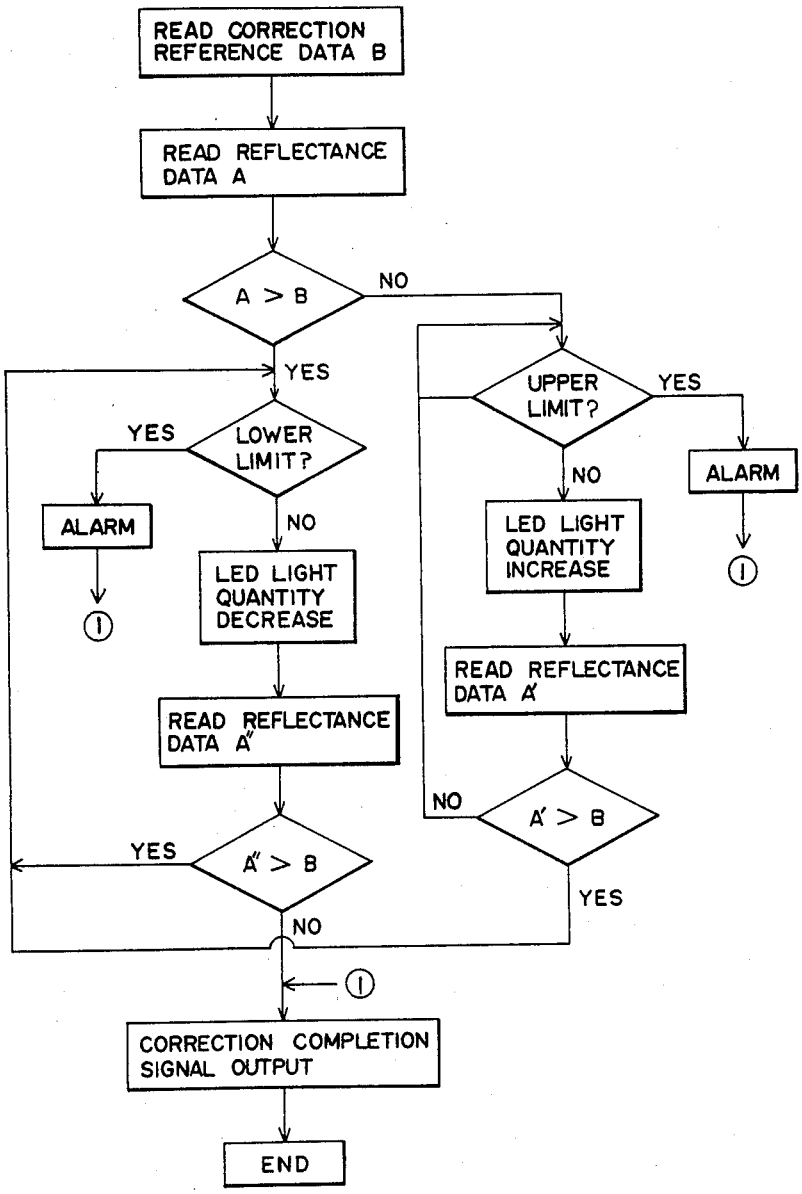
FIG. 6 is a flowchart of the present invention.

FIG. 6 shows a flowchart of the present invention.

In the present invention, after the correction reference data B and the reflectance data A are read, both data are compared. When $A<B$ due to the contamination of the sensor, it is investigated whether the voltage applied on the LED according to the reference data reaches the upper limit or not.

If it is not reached to the upper limit, the light quantity is increased by increasing the voltage to be applied. Then, the reflectance data A′ is read and compared with B as mentioned above.

Conversely, when $A>B$, it is investigated whether the voltage is not lower than the lower limit or not. If it is not lower than the lower limit, the light quantity is decreased.

Then, A″ and B are compared with each other and if it is acceptable the correction completion signal is outputted, so that the sensor correction is ended.

In the present invention, when the voltage is over the upper or lower limit, it is capable of making known the maintenance to be necessary by generating an alarm.

Further, the flowchart shows that the light quantity is decreased again after it is increased. This is because that the light quantity after correction should be set at the reference value with a high precision.

It is possible to correct precisely within a shorter time of period the light quantity, if the increasing or decreasing amount of light quantity is varied according to the difference between A and B.

According to the present invention described above, a decrease in the toner density due to the contamination of the sensor is automatically compensated, and the occurrence of troubles in a toner density control operation can be prevented. The excessive compensation for a decrease in the toner density, which causes the light-emitting element to be broken, can also be prevented. The present invention is also capable of making known the condition of contamination of the sensor when the contamination has progressed in excess of a tolerable level up to which a decrease in the toner density can be compensated.

Since the reference level for controlling the toner density is set variable, a user can set the toner density directly in a desired level.

What is claimed is:

1. A toner density control apparatus comprising:

an image density sensor having a light-emitting element for irradiating a reference image on a photosensitive member, and a light-receiving element for receiving a light reflected from said reference image to detect a density of said image;

means for comparing an output of said sensor with a predetermined level to control a toner density;

means for controlling a voltage to be applied on said light-emitting element according to a difference between an output of said light-receiving element when it receives a light reflected from a non-image surface region on said photosensitive member and correction reference data; and means for generating a signal to be supplied to the outside when said voltage to be applied is increased more than a predetermined value.

2. The toner density control apparatus according to claim 1 wherein said reference image is obtained by developing an image on a reference density plate.

3. The toner density control apparatus according to claim 1 wherein said comparison and the control of radiating light are carried out at a timing after a copy is initiated but before an image is formed.

4. The toner density control apparatus according to claim 1 wherein said control means of the voltage to be applied on said light-emitting element is means for controlling a radiating light.

5. The toner density control apparatus according to claim 4 further comprising means for controlling such that the voltage to be applied on said light-emitting element is suppressed not more than a limited value.

6. The toner density control apparatus according to claim 1 further comprising means for indicating such a state that the voltage to be applied reaches a limited value based on the signal supplied to the outside.

7. The toner density control apparatus according to claim 1 wherein said correction reference data are stored in a ROM.

8. The toner density control apparatus according to claim 1 wherein said light-receiving element is an LED.

9. The toner density control apparatus according to claim 1 wherein said photosensitive member is a drum.

10. The toner density control apparatus according to claim 3 wherein said image formation is a first time of image formation.

* * * * *